United States Patent [19]

Bianchi

[11] 4,426,944

[45] Jan. 24, 1984

[54] SEWING MACHINE HAVING A SUPPLEMENTAL WORK SUPPORTING SURFACE

[75] Inventor: Nereo Bianchi, Pavia, Italy

[73] Assignee: Necchi Societa per Azioni, Pavia, Italy

[21] Appl. No.: 236,511

[22] Filed: Feb. 20, 1981

[30] Foreign Application Priority Data

Feb. 29, 1980 [IT] Italy ..... 42906 A/80

[51] Int. Cl.[3] ..... D05B 73/10

[52] U.S. Cl. ..... 112/260

[58] Field of Search ..... 112/260, 258, 217.1

[56] References Cited

U.S. PATENT DOCUMENTS

| | | | |
|---|---|---|---|
| 3,344,762 | 10/1967 | Szostak et al. | 112/260 |
| 4,204,493 | 5/1980 | Blackwood | 112/260 |
| 4,224,887 | 9/1980 | Meier | 112/260 |
| 4,314,517 | 2/1982 | Kasahara et al. | 112/260 |

*Primary Examiner*—Werner H. Schroeder

*Assistant Examiner*—Andrew M. Falik

*Attorney, Agent, or Firm*—Stevens, Davis, Miller & Mosher

[57] ABSTRACT

A sewing machine with a work supporting surface convertible into a free arm, comprising a bed provided with a cantilevered arm containing a bobbin hook, a door pivoting on the cantilevered arm to rotate from a closed position to an opened position for access to the hook, and a movable work supporting surface which can be moved to an operatively raised position and an operatively lowered position at which lowered position the free arm is completely accessible. The support work surface comprises a U-shaped element, a plate slidable on suitable guides positioned on the work supporting surface in the front portion of the work supporting surface, a latch connected to the plate and a wall defining a relief and tooth connected to the door to couple with the plate latch to allow the opening and/or closing of the door every time that the plate is urged to take the extreme position of its stroke.

5 Claims, 10 Drawing Figures

SEWING MACHINE HAVING A SUPPLEMENTAL WORK SUPPORTING SURFACE

BACKGROUND OF THE INVENTION

The present invention relates to a sewing machine having a work supporting surface convertible into a free arm.

In some of the prior art sewing machines of this type an extra or supplemental base was provided separately detachable from the sewing machine head. This arrangement was found to be inconvenient for the operator when either altering the sewing operation from a flat to a tubular fabric or storing the machine in a portable case. In addition, the supplemental base when separated from the main base necessitated larger storage space with the added possibility of its being lost.

In other known prior art the supplemental base is hinged to the sewing machine and swings out of the way when not in use. A disadvantage of this arrangement is that a larger area was required for the operation of the sewing machine and often times the activity of the operator was hindered.

SUMMARY OF THE INVENTION

The present invention relates to a sewing machine having a work supporting surface convertible into a free arm and comprising a bed having a free arm containing a hook, a door pivoting on the free arm covering a recess where the hook is contained and rotating from a closed position to an opened position, a standard rising from the bed, an upper arm connected to the bed extending horizontally over it on the end of which is a head, a needle bar being contained in the head mounted on suitable mountings provided in the head, and a work supporting surface forming an element of an articulated system and arranged to take a raised operative position and a lowered position wherein the free arm is completely free from said surface.

An object of the present invention is to provide a device to convert from the work supporting surface to the free arm sewing machine. More particularly, the present invention provides fastening means for the work supporting surface in its operative position and means for the hook inspection in this working condition.

In order to attain the object of the invention, the sewing machine is characterized by the fact that the work supporting surface is formed by a U-shaped element, the front portion thereof comprising a plate slidable onto suitable guides located on the work supporting surface. Means are connected to the plate, to couple with corresponding means connected to the door to allow the opening and/or closing thereof every time that the plate is urged to take the extreme position of its stroke.

This feature provides an additional advantage to the use of the mentioned sewing machine when, instead of being placed on a common resting surface such as a table, it is placed on a resting surface of a suitable cabinet, with the surface arranged to displace vertically and being positioned in the cabinet at different heights corresponding to the rest, flat bed sewing and free arm sewing positions. In the flat bed sewing position the work supporting surface of the sewing machine is placed at the level of the upper plane of the cabinet so that the plate can slide a little over the upper plane of the cabinet to cause opening or closing of the door closing the recess where the hook is placed. It is possible, in this way, to reach the hook without providing further means on the cabinet.

Moreover the sewing machine is characterized in that the work supporting surface, in its operative position, is provided with two vertical walls, a front wall and a side wall, hinged in correspondence with their upper sides onto the peripheral sides of the work supporting surface and fastening coupling means are provided on both walls in order to render the work supporting surface steady in its raised operative position.

BRIEF DESCRIPTION OF THE DRAWINGS

Further advantages and characteristics of the invention will be apparent from the following description of a preferred embodiment and from the enclosed drawings in which.

DETAILED DESCRIPTION OF PREFERRED EMBODIMENT

Figure 1:
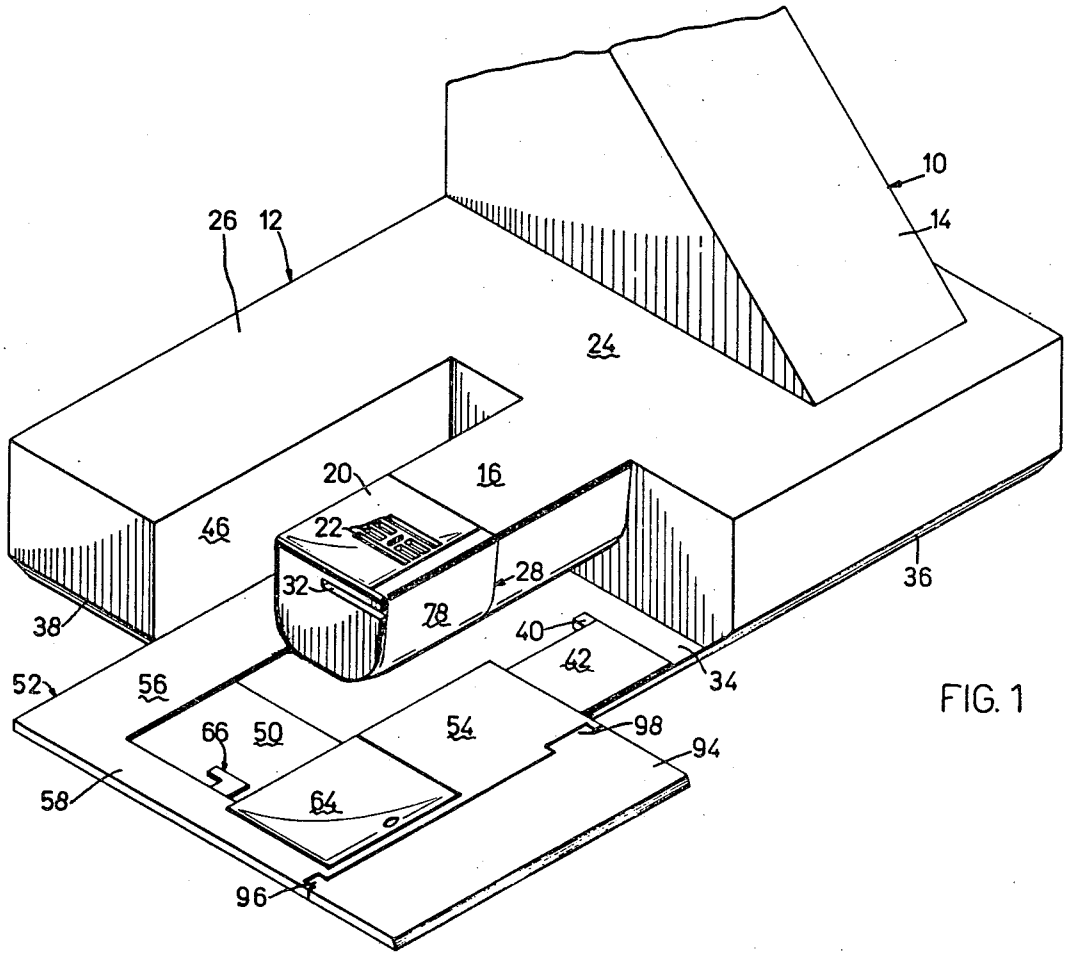
FIG. 1 shows a general perspective view of the sewing machine and of the work supporting surface of the invention in its lowered position.

Referring to FIG. 1, sewing machine 10 has been partially shown, wherein a bed 12, a portion of the standard 14, free arm 16 being a portion of bed 12, and a bobbin hook 18 (FIG. 3) are shown. The fabric feed member and the relevant motion driving elements shaped according to the usual techniques are not shown in the drawings and disclosed in the description. A needle plate 20 is provided with suitable openings 22 for the passage of the feed dogs. Bed 12 has moreover a portion 24 whereon standard 14 is arranged and a portion 26 projecting parallel to free arm 16 and extending beyond the arm.

Figure 3:
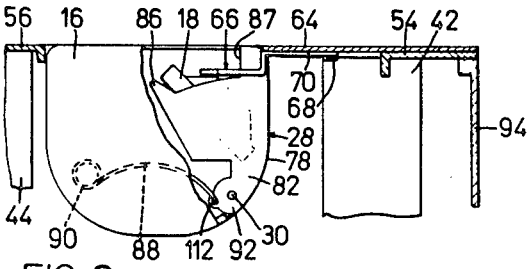
FIG. 3 shows a sectional view along line 3—3 of the portion of sewing machine shown in FIG. 2.

At the free end of cantilevered arm 16 and in its fore portion a door 28 is provided hinged below at 30 (FIGS. 3 and 4) to rotate and then open the recess where the hook 18 is placed. An opening 32 is made in the vertical end wall of free arm 16, whose function will be described hereinafter. Bed 12 of the sewing machine has a plate 34 in its lower portion preferably obtained by being molded with bed 12 and being defined by the prolongation of edges 36 and 38 of the relevant bed portions 24 and 26. Two hinges 40 are located on plate 34 close to portion 24 of bed 12 to which are pivoted two plates 42 and 44 (FIGS. 1, 3, 8).

Figure 2:
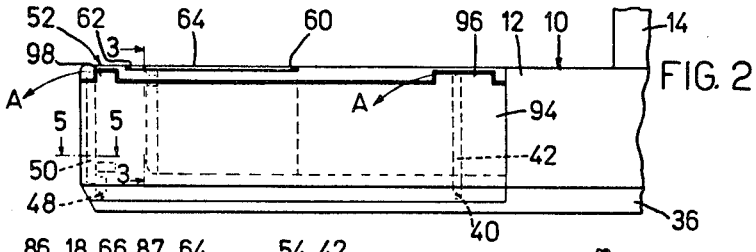
FIG. 2 shows a partial view of the sewing machine of FIG. 1.
Figure 4:
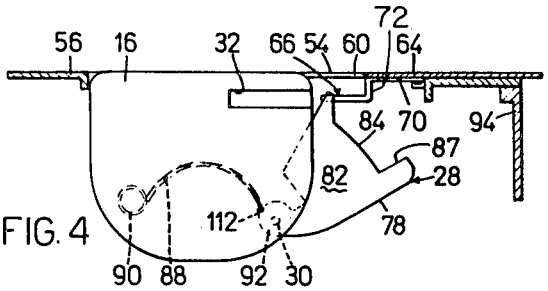
FIG. 4 shows the section of FIG. 3 in a different working condition.
Figure 6:
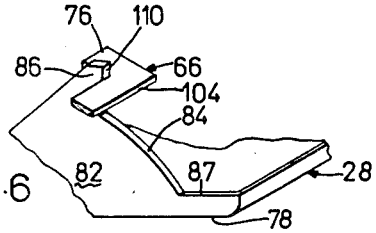
FIG. 6 shows a partial perspective view of the work supporting surface of FIG. 1.
Figure 7:
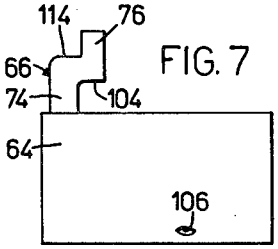
FIG. 7 represents another element of the work supporting surface of FIG. 1.
Figure 8:
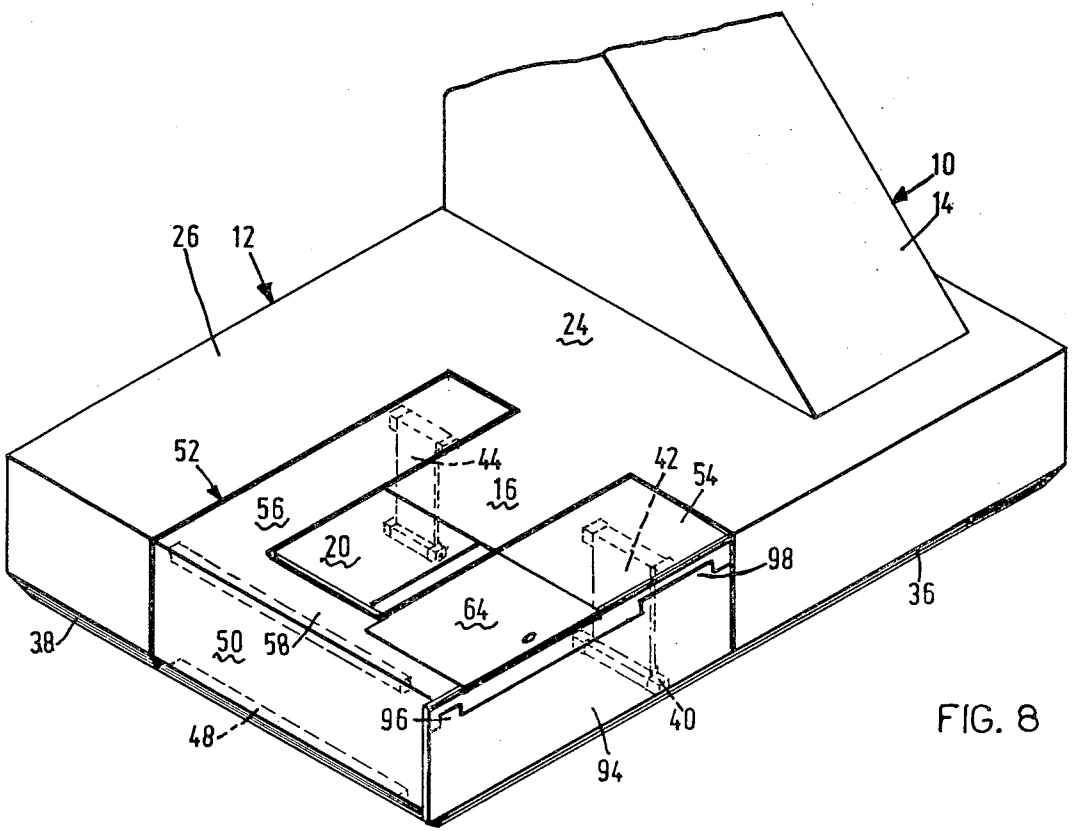
FIG. 8 represents a perspective view of FIG. 1 with the work supporting surface in its operative posi[illegible]
Figure 10:
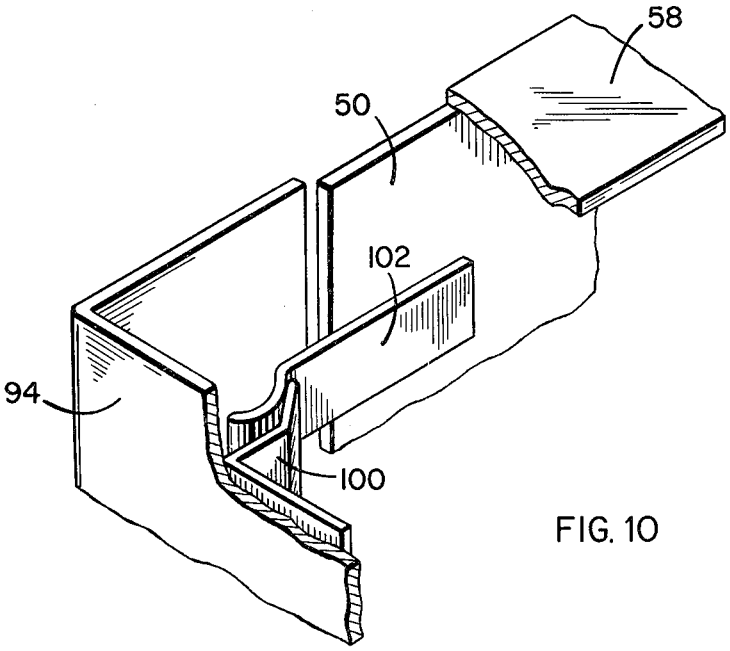
FIG. 10 shows a perspective view of FIG. 5.
Figure 9:
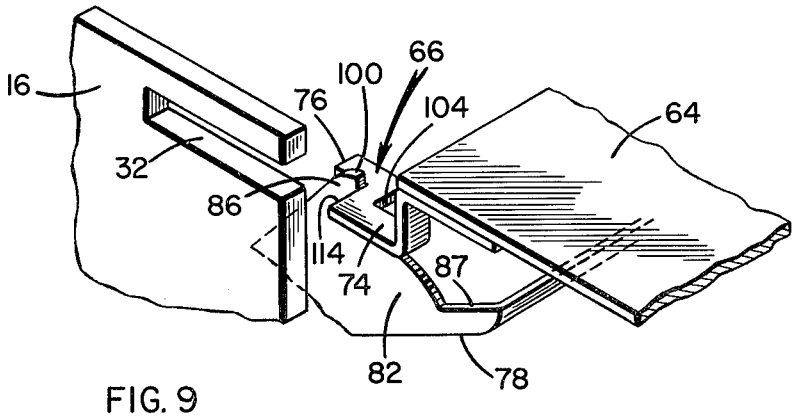
FIG. 9 shows a perspective view of FIG. 4.

A further hinge 48 is located on the opposite side of plate 34 (FIGS. 2 and 8). A wall 50 extending the entire width of plate 34 is pivoted on hinge 48. A U-shaped work supporting surface 52 is provided, hinged to the upper side of plates 42 and 44 and to wall 50, in turn the arms 54 and 56 of surface 52 are hinged to plates 42 and 44 and the bottom of wall 58 is hinged to the upper part of wall 50. The articulated system described above, can be considered, from the kinematic point of view, similar to an articulated parallelogram in which the fixed side or frame, is formed by plate 34, plates 42 and 44 and wall 50 are the crank and the surface 52 is the connecting rod. Plates 42 and 44 and wall 50 have the same length and when they rotate, the surface 52 can assume several positions in height, maintaining always a horizontal position. On arm 54 of surface 52 there are two guides 60 and 62 on which a plate 64 can slide. Under plate 64 (FIGS. 2, 3, 4) a small plate 66 is fixed by means of screws 68. Plate 66 has an extended portion 70 in contact with the lower surface of plate 64, a vertical portion 72 and a horizontal portion having a first part 74 and a second end part 76 shifted sideways relative to the first part 74. The function of plate 66 will be explained hereinafter (FIGS. 4, 7). According to the object of the invention, door 28 for the hook inspection is formed by a front wall 78 hinged at 30 inside free arm 16. A side portion of door 28 at right angle to wall 78 continues with a thin wall 82 (FIGS. 4, 6) having in its upper portion a relief 84 delimited at one side by tooth 86 and at the other side by inside wall 87 of front wall 78 of door 28. Door 28 is urged in its open and closed positions by a spring 88 fixed by an end 90 inside free arm 16 and by the opposite end to portion 92 of door 28. As can be seen from FIGS. 3 and 4 the force exerted by the spring against door 28 is directed, relative to hinge 30, in such a way as to support door closing (FIG. 3) and its opening (FIG. 4) respectively.

In order to close the front of the sewing machine bed when sewing with the surface 52 raised, a wall 94 is provided hinged at 96 and 98 to arm 54 of the surface 52 (FIGS. 1 and 2).

When the sewing machine is arranged for sewing with the free arm (FIG. 1), wall 94 is placed horizontally thus forming a widening of the surface 52. When the sewing machine is operated with the surface 52 in its upper position, wall 94 stands vertically and forms a closing of the sewing machine bed.

Figure 5:
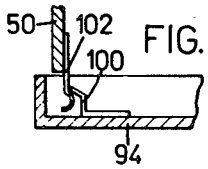
FIG. 5 shows a section along line 5—5 of a portion shown in FIG. 2.

In order to fasten wall 94 in this position and, consequently, all the surface 52 in its working position a plate 100 is provided in the lower inside portion of wall 94 and a spring 102 projects from side closing wall 50 (FIG. 5). From FIG. 5 the engagement of the latching device is immediately realizable, by the conformation of the two elements 100 and 102, which however will be more understandable from the following description of the working of all the assembly in the conversion from the free arm to the flat bed position. With the sewing machine arranged for the free arm sewing, work supporting surface 52 is completely lowered and rests on plate 34 as shown in FIG. 1. Cantilevered free arm 16 is completely free to receive pieces of garment of tubular shape, whereon sewing operations of any kind may be executed.

In order to arrange the sewing machine with the work supporting surface 52 raised (FIG. 2), the operator only must grasp said work supporting surface and raising it, cause the plates 42, 44 and 50 to make a clockwise rotation. Work supporting surface 52 pivots little by little, while always maintaining a horizontal position until the work position is reached, wherein its upper surface makes a single plane with the upper surface of free arm 16. Portion 76 of plate 66 connected to sliding plate 64 in its movement from the free arm to the flat bed sewing positions penetrates the opening 32 in the end wall of free arm 16 and arranges itself into relief 84 of wall 82 of door 28 (FIG. 3). Walls 50 and 94 dispose themselves in vertical positions upon closing of the sewing machine bed during the movement of work supporting surface 52.

In order to lock the work supporting surface 52 into its raised operating position a light pressure must be exerted on the lower portion of wall 94.

With reference to FIG. 5 the small plate 100, fixed to wall 94, resiliently strains the free arched portion of spring 102 to fasten the two walls 50 and 94 of the work supporting surface 52.

If a hook inspection, bobbin change or any other operation is desired, slidable plate 64 is caused to slide toward the fore portion of the sewing machine by action of the fingernail on the surface 106.

By such action, wall 104 of small plate 66, presses against wall 87 of thin wall 82 of door 28 and drags door 28 into an open position as long as the pivot point 112 of spring 88 with the hinged portion 92 of door 28 has reached such a position that the force of spring 88 exerts an opening action on the door until the point where plane surface 110 contacts surface 114 of plate 66. In such an open position of door 28, portion 76 of plate 66 positions itself behind tooth 86 of wall 82 of door 28. With this open arrangement, the lowering of the work supporting surface 52 is not possible, because the work supporting surface is integral with plate 66 (FIGS. 4 and 6). To close door 28, plate 64 must slide in the opposite direction.

Surface 114 of plate 66 presses onto surface 110 of tooth 86 and forces the closing of door 28, by the action of spring 88 (FIG. 3). In order to lower work supporting surface 52 it is necessary to exert a pull on the lower portion of wall 94 to disengage plate 100 from spring 102 of wall 50. Owing to gravity, work supporting surface 52, together with plates 42 and 44 and wall 50 move downwardly in the direction of A arrow (FIG. 2) to take the position of FIG. 1.

As already disclosed in the introductory part, the device for opening and closing of door 28 for the hook inspection is particularly advantageous when the sewing machine rests on a suitable cabinet and is fastened to a resting surface which can shift vertically on the same cabinet and position itself at three different heights corresponding to the inactive flat bed and free arm sewing positions. For the flat bed sewing position, the sewing machine must be positioned on the cabinet in such a way that work supporting surface 52 in working position reaches the same level as the upper surface of the cabinet. In the working position, plate 64 will be able to make its own displacements, as disclosed hereinabove, in order to open door 28 for access to hook 18. For this it is sufficient that plate 64 is placed at a slightly higher level than the upper surface of the cabinet so as to avoid interference with the upper surface of the cabinet during the opening and closing of door 28.

For the free arm sewing, the sewing machine is raised to a sufficient height relative to the upper surface of the cabinet, and in this position the lowering of the work supporting surface will be made through the same described operations.

What is claimed is:

1. In a sewing machine with a work supporting surface having a front side, said surface being convertible into a free arm, comprising a bed provided with a cantilevered arm containing a bobbin hook, a door pivoting on said cantilevered arm to rotate from a closed position to an opened position for access to said hook, a movable work supporting surface adapted to take an operatively raised position and an operatively lowered position at which lowered position the free arm is completely accessible, said work supporting surface comprising a U-shaped element, a plate slidable on suitable guides positioned on the front side of the work supporting surface, means connected to said plate and means connected to said door to couple with said plate means to allow the opening and/or closing of said door every time that the said plate is urged to take the extreme position of its stroke.

2. The sewing machine according to claim 1, wherein said work supporting surface in its operatively raised position defines a vertical front wall and a vertical side wall, both hinged in correspondence with their upper sides on the peripheral sides of said work supporting surface and fastening coupling means provided on both walls in order to render said work supporting surface steady in its raised operative position.

3. The sewing machine according to claim 1, wherein said door means are a relief, delimited by two slanted walls, made from a side wall of said door, said plate means being provided with two vertical walls for interfering with said slanted wall during the displacements of said sliding plate.

4. The sewing machine according to claims 1, 2, or 3, wherein said door means defines a tooth, and plate means connected to the slidable plate has an end portion adapted to interfere, when the door is opened with said tooth on said wall of the door to avoid lowering of the work supporting surface.

5. The sewing machine according to claim 2, wherein said coupling fastening means formed by an element provided on the lower portion inside of said front wall and a spring element projecting from said side wall are arranged in such a way as to couple along with said plate means to fasten together the walls.

* * * * *